US012195905B2

(12) United States Patent
Driussi et al.

(10) Patent No.: US 12,195,905 B2
(45) Date of Patent: Jan. 14, 2025

(54) LAUNDRY TREATMENT APPLIANCE WITH COORDINATED DRAWING UP OF TREATMENT AGENT

(71) Applicant: Electrolux Appliances Aktiebolag, Stockholm (SE)

(72) Inventors: Paolo Driussi, Porcia (IT); Paolo Quattrin, Porcia (IT); Martino Bondi, Porcia (IT); Andrea Zattin, Porcia (IT); Elisa Stabon, Porcia (IT); Andrea Mazzon, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 990 days.

(21) Appl. No.: 17/271,098

(22) PCT Filed: Aug. 23, 2019

(86) PCT No.: PCT/EP2019/072621
§ 371 (c)(1),
(2) Date: Feb. 24, 2021

(87) PCT Pub. No.: WO2020/043626
PCT Pub. Date: Mar. 5, 2020

(65) Prior Publication Data

US 2021/0254254 A1 Aug. 19, 2021

(30) Foreign Application Priority Data

Aug. 30, 2018 (EP) ..... 18191671

(51) Int. Cl.
*D06F 34/04* (2020.01)
*D06F 23/02* (2006.01)
(Continued)

(52) U.S. Cl.
CPC ..... *D06F 34/04* (2020.02); *D06F 23/02* (2013.01); *D06F 33/37* (2020.02); *D06F 39/02* (2013.01);
(Continued)

(58) Field of Classification Search
CPC ..... D06F 34/04
See application file for complete search history.

(56) References Cited

U.S. PATENT DOCUMENTS

2010/0006593 A1 1/2010 Hellweg

FOREIGN PATENT DOCUMENTS

| | | |
|---|---|---|
| EP | 2602378 A1 | 6/2013 |
| GB | 2311767 A | 10/1997 |
| WO | 2011029766 A1 | 3/2011 |

OTHER PUBLICATIONS

International Search Report and Written Opinion for International Application No. PCT/EP2019/072621, dated Oct. 17, 2019, 9 pages.

*Primary Examiner* — Jason Y Ko
(74) *Attorney, Agent, or Firm* — Bradley Arant Boult Cummings LLP

(57) ABSTRACT

A laundry treatment appliance having: a drawer comprising first and second compartments each being adapted to contain multiple doses of a treatment agent for laundry treatment, first and second pumps adapted to draw up treatment agent doses from the first and second compartments, respectively, and a control unit for controlling the first and second pumps, wherein the control unit is configured to cause the first and second pumps to coordinately draw up the treatment agent doses over at least one washing cycle by determining a gradual concurrent emptying of the first and second compartments over said at least one washing cycle.

20 Claims, 5 Drawing Sheets

(51) Int. Cl.

| | |
|---|---|
| ***D06F 33/37*** | (2020.01) |
| ***D06F 39/02*** | (2006.01) |
| *D06F 101/00* | (2020.01) |
| *D06F 101/20* | (2020.01) |
| *D06F 103/00* | (2020.01) |
| *D06F 105/42* | (2020.01) |
| *D06F 105/58* | (2020.01) |

(52) U.S. Cl.
CPC ..... *D06F 39/022* (2013.01); *D06F 2101/00* (2020.02); *D06F 2101/20* (2020.02); *D06F 2103/00* (2020.02); *D06F 2105/42* (2020.02); *D06F 2105/58* (2020.02)

LAUNDRY TREATMENT APPLIANCE WITH COORDINATED DRAWING UP OF TREATMENT AGENT

This application is a U.S. National Phase application of PCT International Application No. PCT/EP2019/072621, filed Aug. 23, 2019, which claims the benefit of European Application No. 18191671.9, filed Aug. 30, 2018, both of which are incorporated by reference herein.

FIELD OF THE INVENTION

The present invention generally relates to the field of laundry treatment appliances (hereinafter, concisely, "laundry appliances"), and particularly to laundry appliances for treating, e.g. washing, items (such as linen, clothes, garments, shoes, and the like), such as laundry washing appliances and laundry washing appliances also implementing laundry drying functions (also referred to as washers/dryers). More particularly, the present invention relates to a laundry appliance with an improved drawing up of treatment agent.

BACKGROUND OF THE INVENTION

A laundry appliance typically comprises a drawer having drawer compartments for containing one or more treatment agents.

In an increasingly common type of laundry appliance, the drawer comprises one or more compartments each one adapted to contain multiple doses of a respective treatment agent for performing multiple washing cycles (hereinafter referred to as multi-dose compartments): just as an example, in case of two multi-dose compartments, a multi-dose compartment may be arranged to contain multiple doses of a liquid washing detergent, whereas the other multi-dose compartment may be arranged to contain multiple doses of a liquid softener. In this class of laundry appliance, the laundry appliance may implement an auto-dosing functionality in which, at each washing cycle (and when the auto-dosing functionality is activated), a predetermined amount of treatment agent (usually referred to as treatment agent dose) is automatically taken from the multi-dose compartment(s) (e.g., by means of one or more pump devices associated therewith) and dispensed to a treatment chamber (such as a washing tub).

SUMMARY OF INVENTION

The Applicant has realized that the typical laundry appliances implementing the auto-dosing functionality are not satisfactory.

In fact, considering for example laundry appliances featuring two multi-dose compartments, the Applicant has noticed that, when both multi-dose compartments are configured to contain same type of treatment agents, the treatment agent doses are drawn up from a multi-dose compartment only after the other multi-dose compartment has emptied. Therefore, in the known laundry appliances, one of the multi-dose compartments is emptied much before the other one, and hence it may be unused even for relatively long periods of time (i.e. until it is filled again, which typically takes place when also the other multi-dose compartment becomes empty).

This involves that, in time, residues of treatment agent in the unused multi-dose compartment and/or in (unused) ducts or pipes of the associated unused pump device dry out and form encrustations or fouling that preclude a correct operation of the laundry appliance: in fact, in addition to promote accumulation of dirt (which contrasts with the purposes of sanitization of the laundry load), treatment agent incrustations in the unused multi-dose compartment may also detach from compartment walls and be flushed undissolved through the pump device(s) (which could cause obstructions thereof) or through the treatment chamber (which could preclude a correct washing of the laundry load housed therein), whereas treatment agent incrustations in the unused pipes may prevent a correct flow of the treatment agent therethrough.

In view of the above, it is an object of the present invention to provide a laundry appliance able to overcome these, as well as other, drawbacks, and particularly it is an object of the present invention to provide a laundry appliance featuring an improved and efficient drawing up of the treatment agent doses from the multi-dose compartments.

One or more aspects of the present invention are set out in the independent claims, with advantageous features of the same invention that are indicated in the dependent claims.

An aspect of the present invention relates to a laundry treatment appliance.

According to an embodiment, the laundry treatment appliance comprises a drawer advantageously comprising a first and a second compartments.

According to an embodiment, additional or alternative to the previous embodiment, each one of the first and second compartments is adapted to contain multiple doses of a treatment agent for laundry treatment.

According to an embodiment, additional or alternative to any of the previous embodiments, the laundry treatment appliance comprises first and second pump devices preferably adapted to draw up treatment agent doses from the first and second compartments.

According to an embodiment, additional or alternative to any of the previous embodiments, the laundry treatment appliance comprises a control unit for controlling the first and second pump devices.

According to an embodiment, additional or alternative to any of the previous embodiments, the control unit is configured to cause the first and second pump devices to coordinately draw up the treatment agent doses over at least one washing cycle, preferably by determining a gradual concurrent emptying of the first and second compartments over said at least one washing cycle.

According to an embodiment, additional or alternative to any of the previous embodiments, the first and second compartments are each one configurable to contain multiple doses of a first type of treatment agent or of a second type of treatment agent for softening treatment.

According to an embodiment, additional or alternative to any of the previous embodiments, the first type of treatment agent is a treatment agent for washing treatment.

According to an embodiment, additional or alternative to any of the previous embodiments, the second type of treatment agent is a treatment agent for softening treatment.

According to an embodiment, additional or alternative to any of the previous embodiments, the control unit is configured to cause the first and second pump devices to coordinately draw up the treatment agent doses over at least one washing cycle when the first and second compartments are configured to contain the same type of treatment agent.

According to an embodiment, additional or alternative to any of the previous embodiments, the at least one washing cycle comprises a single washing cycle, the control unit being for example configured to cause the first and second pump devices to draw up the treatment agent doses during said single washing cycle.

According to an embodiment, additional or alternative to any of the previous embodiments, the control unit is configured to cause the first and second pump devices to draw up the treatment agent doses at a same phase of said single washing cycle.

According to an embodiment, additional or alternative to any of the previous embodiments, the control unit is configured to cause the first and second pump devices to draw up the treatment agent doses at the same time during said single washing cycle.

According to an embodiment, additional or alternative to any of the previous embodiments, the control unit is configured to cause the first and second pump devices to draw up the treatment agent doses from the first and second compartments in such a way to determine, during the single washing cycle, substantially same level variations of the treatment agents contained in the first and second compartments.

According to an embodiment, additional or alternative to any of the previous embodiments, the treatment agent doses drawn up from the first and second compartments are respective first and second portions of an overall amount of treatment agent to be used during the single washing cycle. Said first and second portions are preferably determined according to capacities of the first and second compartments. Additionally or alternatively, said first and second portions are determined according to said overall amount of treatment agent to be used during the single washing cycle.

According to an embodiment, additional or alternative to any of the previous embodiments, the at least one washing cycle comprises a first washing cycle and a second washing cycle, and the treatment agent doses comprise first and second treatment agent doses. The control unit may for example be configured to cause the first and second pump devices to draw up the first and second treatment agent doses during said first and second washing cycles, respectively.

According to an embodiment, additional or alternative to any of the previous embodiments, the control unit is configured to cause the first and second pump devices to draw up the treatment agent doses by controlling rotor speeds of the first and second pump devices, and/or by controlling activation times of the first and second pump devices.

According to an embodiment, additional or alternative to any of the previous embodiments, when the first or the second compartment contains an amount of treatment agent below respective first and second threshold amounts indicative of an emptying condition of the first and second compartments, respectively, the control unit is configured to cause only the second or the first pump device, respectively, to draw up the treatment agent doses from the second or the first compartment, respectively.

Preferably, the first and second threshold amounts are indicative of an emptying condition of the first and second compartments, respectively. Additionally or alternatively, the first threshold amount is different from the second threshold amount.

According to an embodiment, additional or alternative to any of the previous embodiments, the laundry treatment appliance further comprises at least one input selector for allowing the user to select an operation mode in which the control unit is configured to cause the first and second pump devices to draw up the treatment agent doses coordinately over the at least one washing cycle.

According to an embodiment, additional or alternative to any of the previous embodiments, the laundry treatment appliance further comprises at least one display region for displaying a graphical indication of the selected operation mode.

The at least one display region preferably comprises first and second display regions, the first and second display regions being preferably associated with the first and second compartments, respectively. Said graphical indication of the selected operation mode may comprise, in each one of said first and second display regions, a symbol indicative of the type of treatment agent. Additionally or alternatively, said graphical indication of the selected operation mode may comprise a symbol indicative of the selected operation mode.

According to an embodiment, additional or alternative to any of the previous embodiments, the at least one input selector comprises a first and a second input selectors, the first and second input selectors being for example associated with the first and second compartments, respectively. Said operation mode is advantageously selectable (e.g., by the user) by means of the first and/or second input selectors.

According to an embodiment, additional or alternative to any of the previous embodiments, said operation mode is selectable (e.g., by the user) by means of a predefined actuation sequence of the first and/or second input selectors.

According to an embodiment, additional or alternative to any of the previous embodiments, at least one of the at least one input selector is configurable to provide, preferably in addition to one or more default functions thereof, an adjusting function for allowing the user to adjust the treatment agent doses with respect to reference treatment agent doses.

According to an embodiment, additional or alternative to any of the previous embodiments, said at least one of the at least one input selector is configurable, e.g. through an external device being external to the laundry treatment appliance.

According to an embodiment, additional or alternative to any of the previous embodiments, said at least one of the at least one input selector comprises the first input selector or the second input selector.

Another aspect of the present invention relates to method for operating a laundry treatment appliance. The laundry treatment appliance preferably comprises a drawer advantageously comprising a first and a second compartments. The first and second compartments are each one adapted to contain multiple doses of a treatment agent for laundry treatment. The laundry treatment appliance preferably comprises first and second pump devices adapted to draw up treatment agent doses, preferably from the first and second compartments, respectively.

The method preferably comprises causing the first and second pump devices to coordinately draw up the treatment agent doses over at least one washing cycle, preferably by determining a gradual concurrent emptying of the first and second compartments over said at least one washing cycle.

According to an embodiment, additional or alternative to the previous embodiment, the method further comprises configuring the first and second compartments to contain each one multiple doses of a first type of treatment agent or of a second type of treatment agent. Said causing the first and second pump devices to coordinately draw up the treatment agent doses over at least one washing cycle preferably comprising causing the first and second pump devices to coordinately draw up the treatment agent doses over at least one washing cycle, advantageously when the first and second compartments are configured to contain the same type of treatment agent.

According to an embodiment, additional or alternative to any of the previous embodiments, the first type of treatment agent is a treatment agent for washing treatment.

According to an embodiment, additional or alternative to any of the previous embodiments, the second type of treatment agent is a treatment agent for softening treatment.

According to an embodiment, additional or alternative to any of the previous embodiments, the at least one washing cycle comprises a single washing cycle. Said causing the first and second pump devices to coordinately draw up the treatment agent doses over at least one washing cycle preferably comprises causing the first and second pump devices to coordinately draw up the treatment agent doses during said single washing cycle.

According to an embodiment, additional or alternative to any of the previous embodiments, said causing the first and second pump devices to coordinately draw up the treatment agent doses during said single washing cycle comprises causing the first and second pump devices to coordinately draw up the treatment agent doses at a same phase of said single washing cycle.

According to an embodiment, additional or alternative to any of the previous embodiments, said causing the first and second pump devices to coordinately draw up the treatment agent doses over at least one washing cycle comprises causing the first and second pump devices to coordinately draw up the treatment agent doses at the same time during said single washing cycle.

According to an embodiment, additional or alternative to any of the previous embodiments, said causing the first and second pump devices to coordinately draw up the treatment agent doses over at least one washing cycle comprises causing the first and second pump devices to determine substantially same level variations of the treatment agents contained in the first and second compartments over said at least one washing cycle.

According to an embodiment, additional or alternative to any of the previous embodiments, the treatment agent doses drawn up from the first and second compartments are respective first and second portions of an overall amount of treatment agent to be used during the single washing cycle. The method advantageously comprises determining said first and second portions according to capacities of the first and second compartments and, additionally or alternatively, according to said overall amount of treatment agent to be used during the single washing cycle.

According to an embodiment, additional or alternative to any of the previous embodiments, the at least one washing cycle comprises a first washing cycle and a second washing cycle, and the treatment agent doses comprise first and second treatment agent doses. Said causing the first and second pump devices to coordinately draw up the treatment agent doses over at least one washing cycle advantageously comprises causing the first and second pump devices to coordinately draw up the first and second treatment agent doses during said first and second washing cycles, respectively.

According to an embodiment, additional or alternative to any of the previous embodiments, said causing the first and second pump devices to coordinately draw up the treatment agent doses over at least one washing cycle comprises controlling rotor speeds of the first and second pump devices, and/or controlling activation times of the first and second pump devices.

According to an embodiment, additional or alternative to any of the previous embodiments, the method further comprises, e.g. when the first or the second compartment contains an amount of treatment agent below respective first and second threshold amounts, causing only the second or the first pump device, respectively, to draw up the treatment agent doses from the second or the first compartment, respectively.

Preferably, the first and second threshold amounts are indicative of an emptying condition of the first and second compartments, respectively. Additionally or alternatively, the first threshold amount is different from the second threshold amount.

According to an embodiment, additional or alternative to any of the previous embodiments, said causing the first and second pump devices to draw up the treatment agent doses coordinately over the at least one washing cycle is performed upon selection of a corresponding operation mode by a user, preferably by acting on at least one input selector of the laundry treatment appliance.

According to an embodiment, additional or alternative to any of the previous embodiments, the method further comprises displaying a graphical indication of the selected operation mode.

Said graphical indication of the selected operation mode may comprise, e.g. in each one of first and second display regions preferably associated with the first and second compartments, respectively, a symbol indicative of the type of treatment agent. Additionally or alternatively, said graphical indication of the selected operation mode may comprise a symbol indicative of the selected operation mode.

According to an embodiment, additional or alternative to any of the previous embodiments, the at least one input selector comprises a first and a second input selectors preferably associated with the first and second compartments, respectively. Said operation mode is advantageously selectable (e.g., by the user) by means of the first and/or second input selectors.

According to an embodiment, additional or alternative to any of the previous embodiments, said operation mode is selectable (e.g., by the user) by means of a predefined actuation sequence of the first and/or second input selectors.

According to an embodiment, additional or alternative to any of the previous embodiments, the method further comprises configuring at least one of the at least one input selector to provide, preferably in addition to one or more default functions thereof, an adjusting function for allowing the user to adjust the treatment agent doses with respect to reference treatment agent doses.

According to an embodiment, additional or alternative to any of the previous embodiments, said at least one of the at least one input selector is configurable through an external device being external to the laundry treatment appliance.

According to an embodiment, additional or alternative to any of the previous embodiments, said at least one of the at least one input selector comprises the first input selector or the second input selector.

BRIEF DESCRIPTION OF THE ANNEXED DRAWINGS

These and other features and advantages of the present invention will be made apparent by the following description of some exemplary and non-limitative embodiments thereof; for its better intelligibility, the following description should be read making reference to the attached drawings, wherein.

DETAILED DESCRIPTION OF PREFERRED EMBODIMENTS OF THE INVENTION

Figure 1A:
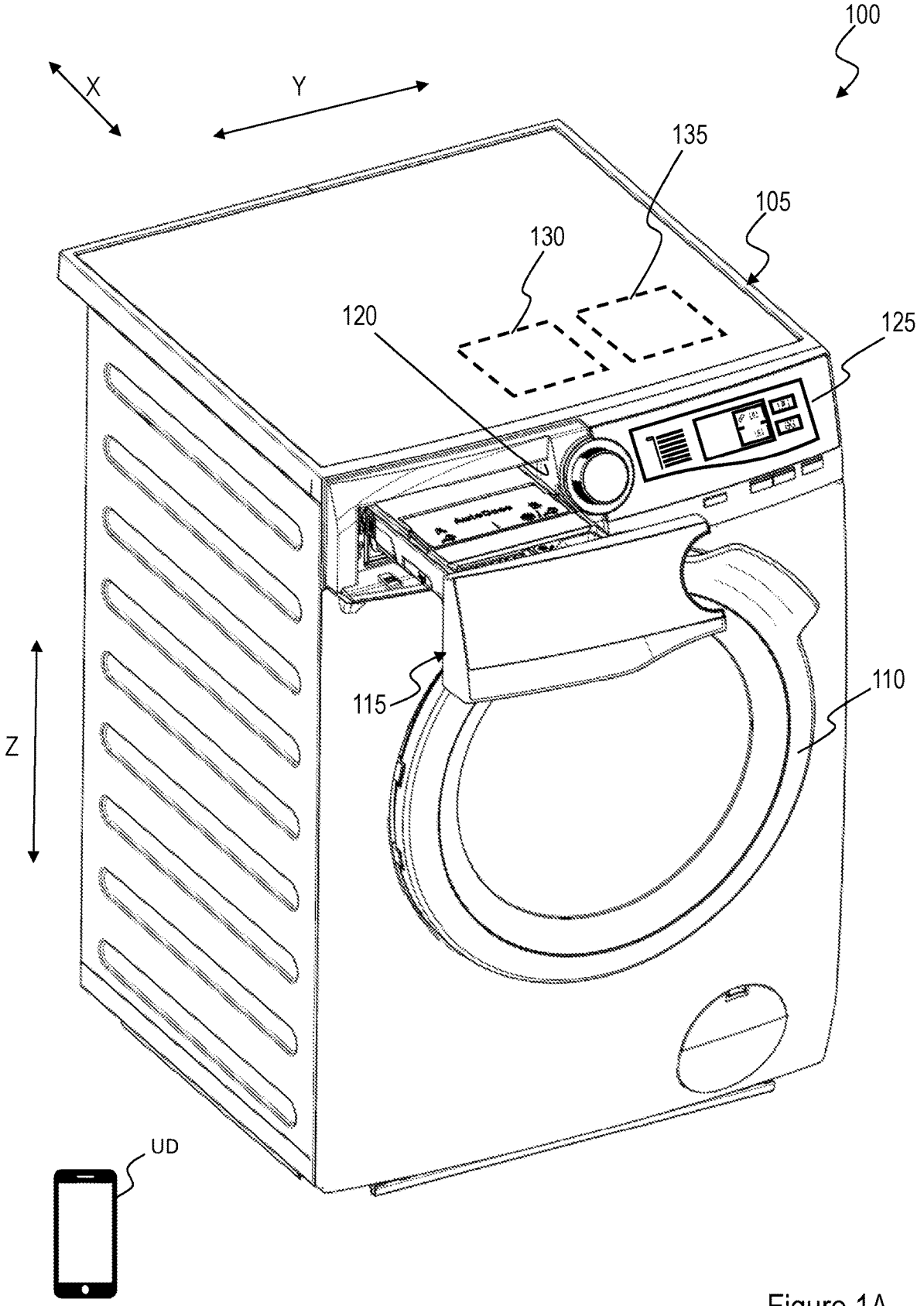
FIGS. 1A and 1B show perspective views of a laundry appliance according to an embodiment of the present invention.
Figure 1B:
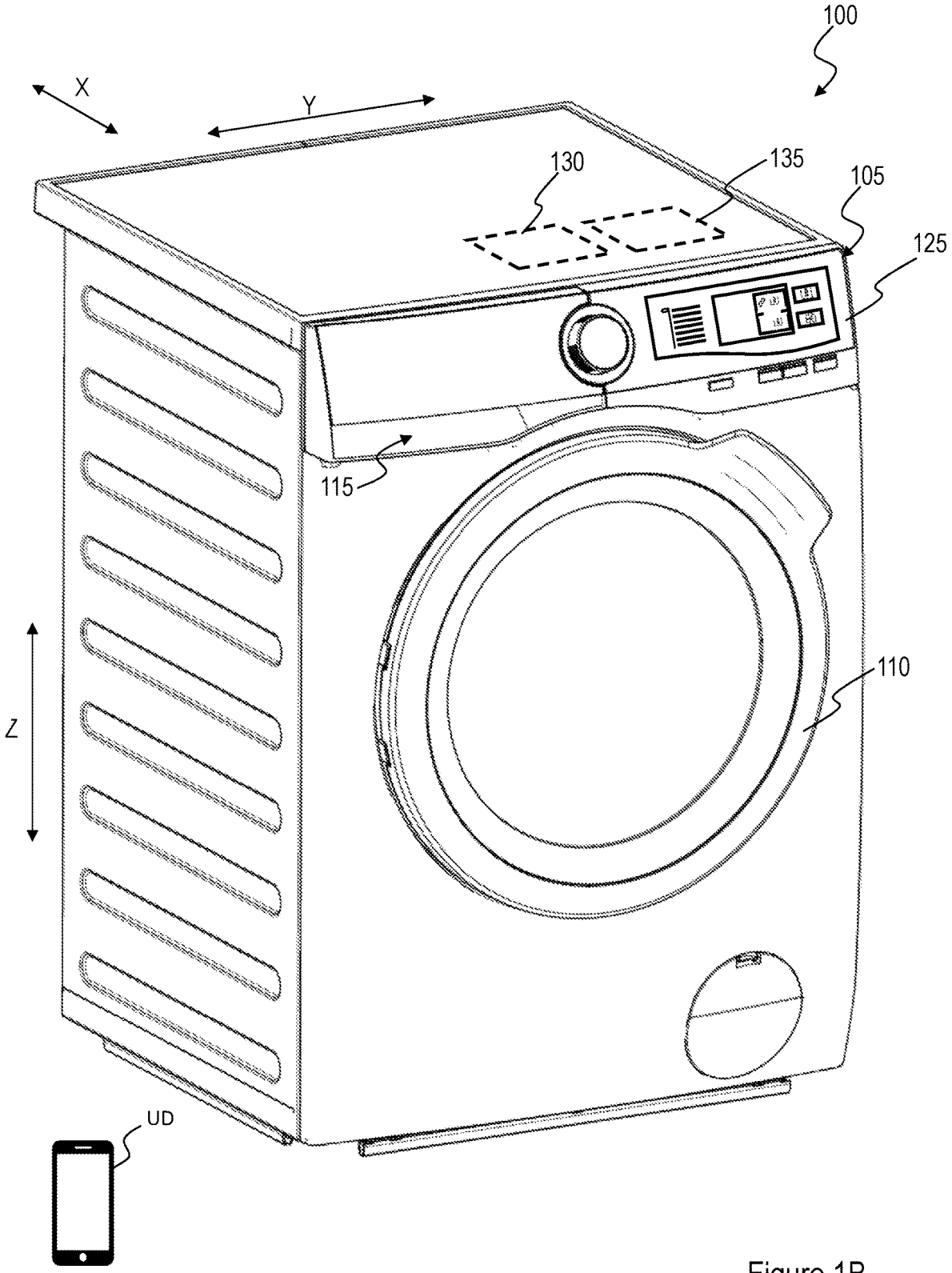

With reference to the drawings, FIGS. 1A and 1B show perspective views of a laundry appliance 100 according to an embodiment of the present invention. According to the exemplary, not limiting, embodiment herein considered, the laundry appliance 100 is a washing machine. In any case, although in the following description explicit reference will be made to a washing machine, this should not to be construed as a limitation; indeed, the present invention applies to other types of laundry appliances (for example combined washers/dryers, i.e. washing machines also having laundry drying functions).

The laundry appliance 100 comprises a (e.g., parallepiped-shaped) cabinet 105, which preferably accommodates a treatment chamber (i.e., a laundry washing chamber in the example herein considered of a washing machine) for performing a treatment cycle on laundry load housed therein (e.g., a washing cycle or program in the example herein considered of a washing machine).

The treatment chamber preferably comprises a washing tub (not shown) and, within it, a (e.g., rotatable) washing basket or drum (not shown) adapted to contain the laundry load to be washed. A cabinet front has a loading opening providing an access to the drum for loading/unloading the laundry load, a door 110 (shown in a closed position in FIGS. 1A and 1B) being provided for sealably closing the loading opening during the operation of the laundry appliance 100.

Although not shown, the laundry appliance 100 also comprises, enclosed in the cabinet 105, electrical/electronic/mechanical/hydraulic components for the operation of the laundry appliance 100 (such as for example motor, electromechanical valves, pump devices and impellers of the hydraulic apparatus, one or more heating elements for heating water/treatment agents/air).

The laundry appliance 100 further comprises a drawer 115 for containing one or more laundry treatment agents (or, concisely, treatment agents), such as liquid and powder treatment agents including, but not limited to, washing detergents, rinsing detergents, bleaches and softeners. The laundry appliance 100 also comprises a drawer seat 120 (preferably provided on a top part of a cabinet front) for housing the drawer 115, the drawer being advantageously adapted to slide within the drawer seat 120, along a longitudinal or sliding direction X, between an extracted position (shown in FIG. 1A) and a retracted position (shown in FIG. 1B). The sliding direction X is for example parallel to a rest surface, such as the floor, on which the laundry appliance 100 preferably rests in operation (i.e., when it is installed in the user premises). In operation, the laundry appliance 100 rests on the rest surface, such as the floor, and uprightly extends from it along a vertical direction Z orthogonal to the sliding direction X.

Preferably, the laundry appliance 100 further comprises a user interface 125, the user interface 125 being preferably provided on the top part of the cabinet front, more preferably next to the drawer seat 120 along a transversal direction Y orthogonal to the longitudinal X and vertical Z directions. An exemplary user interface 125 will be shown and described in the following when discussing an operation mode of the laundry appliance according to embodiments of the present invention.

Preferably, the laundry appliance 100 is further provided with a control unit 130 for controlling the laundry appliance 100 (the control unit 130 being schematically illustrated as a dashed rectangle in FIGS. 1A and 1B) according to instructions received by a user through the user interface 125. For example, the control unit 130 is configured to provide power and to interact with the electrical/electronic/mechanical/hydraulic components in order to manage the execution of selected washing programs; for the purposes of the present disclosure, the control unit 130 is particularly arranged to coordinate a drawing up of the treatment agents contained in the drawer 115.

As illustrated in FIGS. 1A and 1B, the laundry appliance 100 preferably comprises a connection device 135 (for example a network interface controller or network adapter, schematically illustrated as a dashed rectangle in the figures) for allowing a (e.g., wired or wireless) data exchange between the laundry appliance 100 and an external device, for example a user device UD, being external to the laundry appliance 100. The user device UD may for example be a personal digital assistant (PDA), a smartphone (as herein exemplary illustrated), a tablet, a wearable smart device (such as a smartwatch) or other mobile device having processing, input/output and memory units adapted to run software applications (i.e. mobile applications in the example at issue of a smartphone as user device UD). The mobile application run by (i.e., running on) the user device UD is advantageously adapted to present to the user at least a subset of functionalities and/or settings and/or options and/or operation modes allowed by user interface 125; moreover, for the purposes of the present disclosure, the mobile application running on the user device UD is advantageously adapted to present to the user one or more additional functionalities and/or additional settings and/or additional options and/or additional operation modes to be selected (as better discussed in the following).

Figure 2A:
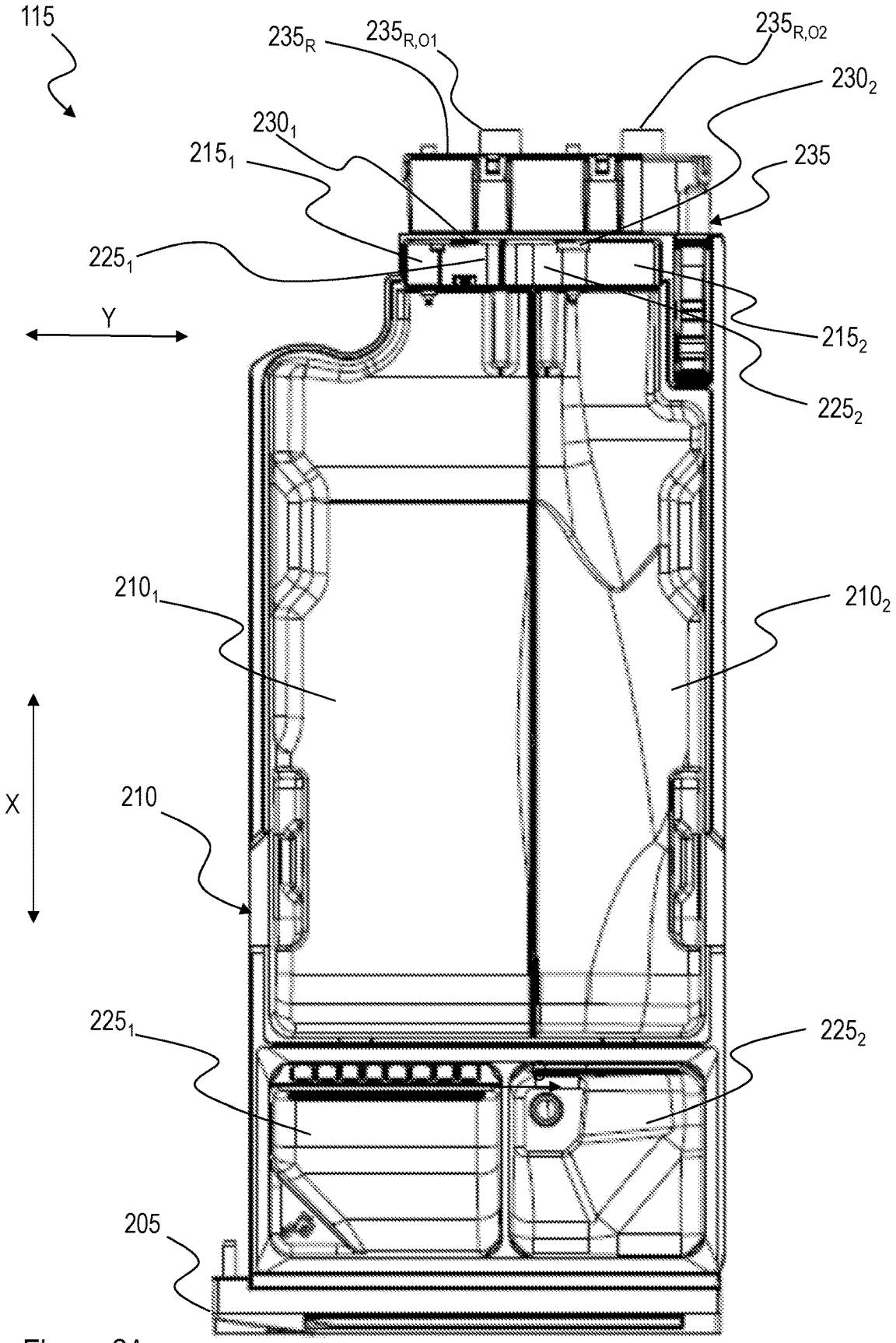
FIG. 2A shows a top view of a drawer of the laundry appliance according to an embodiment of the present invention.

With reference now also to FIG. 2A, it shows top views of the drawer 115 according to an embodiment of the present invention. For ease of description, FIG. 2A will be discussed together with FIG. 2B, which shows a perspective view of the drawer 115 in a partially extracted position within the drawer seat 120.

The drawer 115 preferably comprises a drawer handle 205 allowing the user to slidably move the drawer 115 between the extracted position and the retracted position when it is fitted in the drawer seat 120, and a drawer body 210 to which the drawer handle 205 is adapted to be mounted or coupled or connected (advantageously, in a removable or reversible way). When the laundry appliance 100 is installed and the drawer 115 is fitted in the drawer seat 120, the drawer handle 205 identifies, along the sliding direction X, a drawer front (which advantageously forms part of the cabinet front when the drawer 115 is in the retracted position).

The drawer 115 (particularly, the drawer body 210) preferably comprises two drawer compartments $\mathbf{210}_1$,$\mathbf{210}_2$ (or more thereof) each one adapted to contain multiple doses of a respective treatment agent for multiple laundry treatments (e.g., multiple washing cycles), hereinafter referred to as multi-dose compartments 210$_1$,210$_2$; therefore, the exemplary considered laundry appliance 100 is configured to implement an auto-dosing functionality in which, at each washing cycle (and when the auto-dosing functionality is activated), a predetermined amount of treatment agent (also referred to as treatment agent dose) is automatically taken (e.g. by means of pump devices, discussed in the following) from one or both of the multi-dose compartments 210$_1$,210$_2$.

Each multi-dose compartment 210$_1$,210$_2$ is preferably configurable to contain multiple doses of a respective type of treatment agent. For the purposes of the present disclosure, by type of treatment agent it is herein meant a class of treatment agents having same functions (in this sense, just as an example, pre-washing detergents, washing detergents and softeners identify respective types of treatment agents) or a class of treatment agents that, for the same functions, also have similar chemical properties or compositions or active ingredients (in this sense, just as an example, liquid washing detergents having, for example, different concentration levels or different surfactants may identify respective types of treatment agents).

In the example at issue, each multi-dose compartment 210$_1$,210$_2$ is preferably configurable to contain multiple doses of a treatment agent for washing treatment (e.g., a liquid washing detergent) or of a treatment agent for softening treatment (e.g., a liquid softener), although this should not be construed limitatively.

As better discussed in the following, the type of treatment agent to be fed to the multi-dose compartments 210$_1$,210$_2$ may advantageously be selected by the user (e.g., through the user interface 125 and/or through the mobile application running on the user device UD). Just as an example, user selection may determine the following configurations of the multi-dose compartments 210$_1$,210$_2$:

- the multi-dose compartment 210$_1$ is configured to contain multiple doses of a type of treatment agent (e.g., the liquid washing detergent or the liquid softener) and the multi-dose compartment 210$_2$ is configured to contain multiple doses of another type of treatment agent (e.g., the liquid softener or the liquid washing detergent, respectively). In this configuration of the multi-dose compartments 210$_1$,210$_2$, the laundry appliance 100 may be operated (preferably by default) in a first operation mode (hereinafter referred to as normal operation mode) in which, depending on a selected washing cycle, one or both of the types of treatment agents are drawn up from the respective multi-dose compartments 210$_1$,210$_2$ during the execution of the selected washing cycle;
- both multi-dose compartments 210$_1$,210$_2$ are configured to contain multiple doses of the same type of treatment agent (e.g., both multi-dose compartments 210$_1$,210$_2$ are configured to contain multiple doses of the liquid washing detergent or multiple doses of the liquid softener). In this configuration of the multi-dose compartments 210$_1$,210$_2$, the laundry appliance 100 may be operated (preferably upon user selection) in a second operation mode (hereinafter referred to as coordinated operation mode, which will be better discussed in the following) in which a gradual concurrent emptying of the multi-dose compartments 210$_1$,210$_2$ is exhibited by the laundry appliance 100 over one or more washing cycles. However, nothing prevents from allowing operation of the laundry appliance 100 in the coordinated operation mode even when the multi-dose compartment 210$_1$ is configured to contain multiple doses of a type of treatment agent and the multi-dose compartment 210$_2$ is configured to contain multiple doses of another type of treatment agent.

As can be appreciated in FIG. 2A, the multi-dose compartments 210$_1$,210$_2$ preferably have reciprocally different (or slightly different) areas. When, as herein exemplary considered, same or substantially same extensions along the vertical direction Z for the multi-dose compartments 210$_1$, 210$_2$ are assumed, this difference in area translates into correspondingly different capacities of the multi-dose compartments 210$_1$,210$_2$, although this should not be construed limitatively.

The drawer 115 (particularly, the drawer body 210) preferably comprises one or more (two, in the example at issue) channels 215$_1$,215$_2$ associated with the multi-dose compartments 210$_1$,210$_2$ (in the example herein considered, each channel 215$_1$,215$_2$ is associated with a respective one of the multi-dose compartments 210$_1$,210$_2$, the channel 215$_1$ being for example associated with the multi-dose compartment 210$_1$ and the channel 215$_2$ being for example associated with the multi-dose compartment 210$_2$). Each channel 215$_1$,215$_2$ is preferably adapted to channel water and/or one or more treatment agent doses towards a region of the drawer seat 120 that allows a mixture between the water and the treatment agent dose(s) (hereinafter referred to as mixing region): the mixing region may for example be or comprise a bottom wall 220$_{BW}$ of the drawer seat 120 (visible in FIG. 2B), the bottom wall 220$_{BW}$ of the drawer seat 120 being advantageously slanted in order to promote a flow of the mixture between the water and the treatment agent dose(s) towards the treatment chamber of the laundry appliance 100.

As exemplary illustrated, the channels 215$_1$,215$_2$ are preferably provided, along the sliding direction X, behind the multi-dose compartments 210$_1$,210$_2$ (from the drawer front).

Advantageously, the channels 215$_1$,215$_2$ (or at least one thereof) extend vertically with respect to the rest surface (such as the floor) on which the laundry appliance 100 rests in operation (the channels 215$_1$,215$_2$ thus extending substantially along the vertical direction Z). In alternative embodiments of the present invention, the channels 215$_1$, 215$_2$ (or at least one thereof) are inclined with respect to the rest surface (such as the floor) on which the laundry appliance 100 rests in operation. Regardless of the specific (vertical or inclined) orientation of the channels 215$_1$,215$_2$, which is not limiting for the present invention, each channel 215$_1$,215$_2$ is advantageously structured and shaped such as to allow the water and/or the treatment agent dose(s) to fall towards the mixing region of the drawer seat 120 by gravity; in order to achieve it, each channel 215$_1$,215$_2$ advantageously comprises a top channel input for receiving the water from a water distribution system above it (not shown), and a bottom channel output facing the bottom wall 220$_{BW}$ of the drawer seat 120; in operation, the bottom channel outputs of the channels 215$_1$,215$_2$ are arranged for delivering the water and the treatment agent dose(s) to the bottom wall 220$_{BW}$ of the drawer seat 120, and hence to the treatment chamber of the laundry appliance 100.

According to the preferred embodiment of the present invention herein considered and illustrated, the drawer 115 also comprises one or more (two, in the example at issue) drawer compartments 225$_1$,225$_2$ each one adapted to contain a single dose of a respective treatment agent for performing a single washing cycle, hereinafter referred to as mono-dose compartments 225$_1$,225$_2$; just as an example, the mono-dose compartment $225_1$ may be arranged to contain a single dose of a powder or liquid washing detergent, whereas the mono-dose compartment $225_2$ may be arranged to contain a single dose of a powder or liquid or pearl softener.

Preferably, the mono-dose compartments $225_1$,$225_2$ are, along the sliding direction X, between the drawer handle 205 and the multi-dose compartments $210_1$,$210_2$. Forming the mono-dose compartments $225_1$, $225_2$ before the multi-dose compartments $210_1$,$210_2$ (along the sliding direction X, from the drawer handle 205) is advantageous in that a low or relatively low extraction of the drawer 115 is required for allowing the user to load the treatment agents in the mono-dose compartments $225_1$, $225_2$ (on the contrary, forming the mono-dose compartments $225_1$, $225_2$ behind the multi-dose compartments $210_1$,$210_2$ would dramatically impair the mechanical stability of the drawer 115, for example when extracting the drawer 115 to load the treatment agents in the mono-dose compartments $225_1$,$225_2$ and a certain amount of treatment agent is still stored in one or more of the multi-dose compartments $210_1$,$210_2$).

As visible in the figures, the mono-dose $225_1$,$225_2$ and multi-dose $210_1$,$210_2$ compartments have different capacities; particularly, the multi-dose compartments $210_1$,$210_2$ have larger capacities so as to store larger amounts of treatment agent as compared to the mono-dose compartments $225_1$,$225_2$. Although the mono-dose compartments $225_1$,$225_2$ are illustrated as having same or similar capacities, this should not be construed limitatively.

The laundry appliance 100 also comprises pump devices adapted to draw up treatment agent doses from the multi-dose compartments, with each pump device that is preferably associated with a respective multi-dose compartment $210_1$,$210_2$. In the example herein considered of two multi-dose compartments $210_1$,$210_2$, two pump devices each one for drawing up treatment agent doses from a respective multi-dose compartment $210_1$,$210_2$ are provided.

Preferably, the pump devices are peristaltic pump devices. The pump devices may for example be variable-flow peristaltic pump devices (in which case the control unit 130 may be configured to cause the pump devices to draw up the treatment agent doses by controlling rotor speeds of the pump devices), or fixed-flow peristaltic pump devices (in which case the control unit 130 may be configured to cause the pump devices to draw up the treatment agent doses by controlling activation times of the pump devices e.g., through duty cycle variations of corresponding control or driving signals). However, in alternative embodiment of the present invention, both variable-flow and fixed-flow peristaltic pump devices may be provided (for example, a variable-flow peristaltic pump device associated with one of the multi-dose compartments $210_1$,$210_2$ and a fixed-flow peristaltic pump device associated with the other one of the multi-dose compartments $210_1$,$210_2$).

The pump devices are preferably provided, along the sliding direction X, behind the channels $215_1$,$215_2$ (from the drawer front).

More preferably, the pump devices are structured such that electrical parts thereof are physically separate from drawer portions (such as the multi-dose compartments $210_1$, $210_2$ and the channels $215_1$,$215_2$) experiencing treatment agent and/or water passage, and such that they are substantially unaffected by movement of the drawer 115 from the retracted position to the extracted position. In order to achieve it, each pump device preferably comprises a pump actuation part (advantageously provided in the drawer body 210) and an electrically-operated pump driving part (advantageously provided in the drawer seat 120) adapted to couple to each other when the drawer 115 is in the retracted position, upon said coupling the electrically-operated pump driving parts allowing driving of the pump actuation parts.

Each pump actuation part preferably comprises a respective suction side in fluid communication with the multi-dose compartment $210_1$,$210_2$ for drawing up the treatment agent dose(s) therefrom, and a respective delivery side in fluid communication with the channel $215_1$,$215_2$ for delivering the treatment agent dose(s) thereto.

Preferably, the drawer 115 comprises a suction pipe $225_1$,$225_2$ (visible in FIG. 2A) coupling the suction side of the pump actuation part to an interior of the multi-dose compartment $210_1$,$210_2$ for drawing up the treatment agent dose therefrom, and a delivery pipe $230_1$,$230_2$ coupling the delivery side of the pump actuation part to an interior of the channel $215_1$,$215_2$ for delivering the treatment agent dose thereto. The suction pipe $225_1$,$225_2$ is preferably arranged, in the interior of the respective multi-dose compartment $210_1$,$210_2$, proximate to a bottom wall of the multi-dose compartment $210_1$,$210_2$, so as to allow drawing up of treatment agent doses even when the multi-dose compartment $210_1$,$210_2$ is almost empty. The delivery pipe $230_1$, $230_2$ preferably opens to the interior of the respective channel $215_1$,$215_2$, preferably between (for example, in the middle or substantially in the middle of) the top channel input and the bottom channel output thereof (only end parts of the delivery pipes $230_1$,$230_2$ that open to the interior of the respective channels $215_1$,$215_2$ being visible in FIG. 2A).

Each pump actuation part comprises a respective pumping member (not shown) adapted to push a quantity of the washing agent contained in a respective multi-dose compartment $210_1$,$210_2$ through the respective suction $225_1$, $225_2$ and delivery $230_1$,$230_2$ pipes and, therefore, towards the mixing region of the drawer seat 120. Preferably, the suction $225_1$,$225_2$ and delivery $230_1$,$230_2$ pipes are in the form of deformable tubes, each pumping member preferably comprising a peristaltic rotor (not shown) being adapted to hydraulically cooperate with the respective deformable tubes. More preferably, each peristaltic rotor comprises one or more projecting portions (e.g. in the form of rollers, not visible) adapted to be arranged in contact with the walls of the respective deformable tube and capable of locally compressing it, thus generating a consequent narrowing that allows the fluid (i.e., the treatment agent dose(s)) to move during the rotation of the peristaltic rotor.

Each electrically-operated pump driving part may for example comprise an electric motor (not shown) selectively actuatable (e.g., by means of the electronic control unit 130) for operating the respective pumping member, and an output shaft (not shown) adapted to be fitted into a corresponding seat of the respective pumping member, so as to couple or engage with each other when the drawer 115 is moved to the retracted position.

Figure 2B:
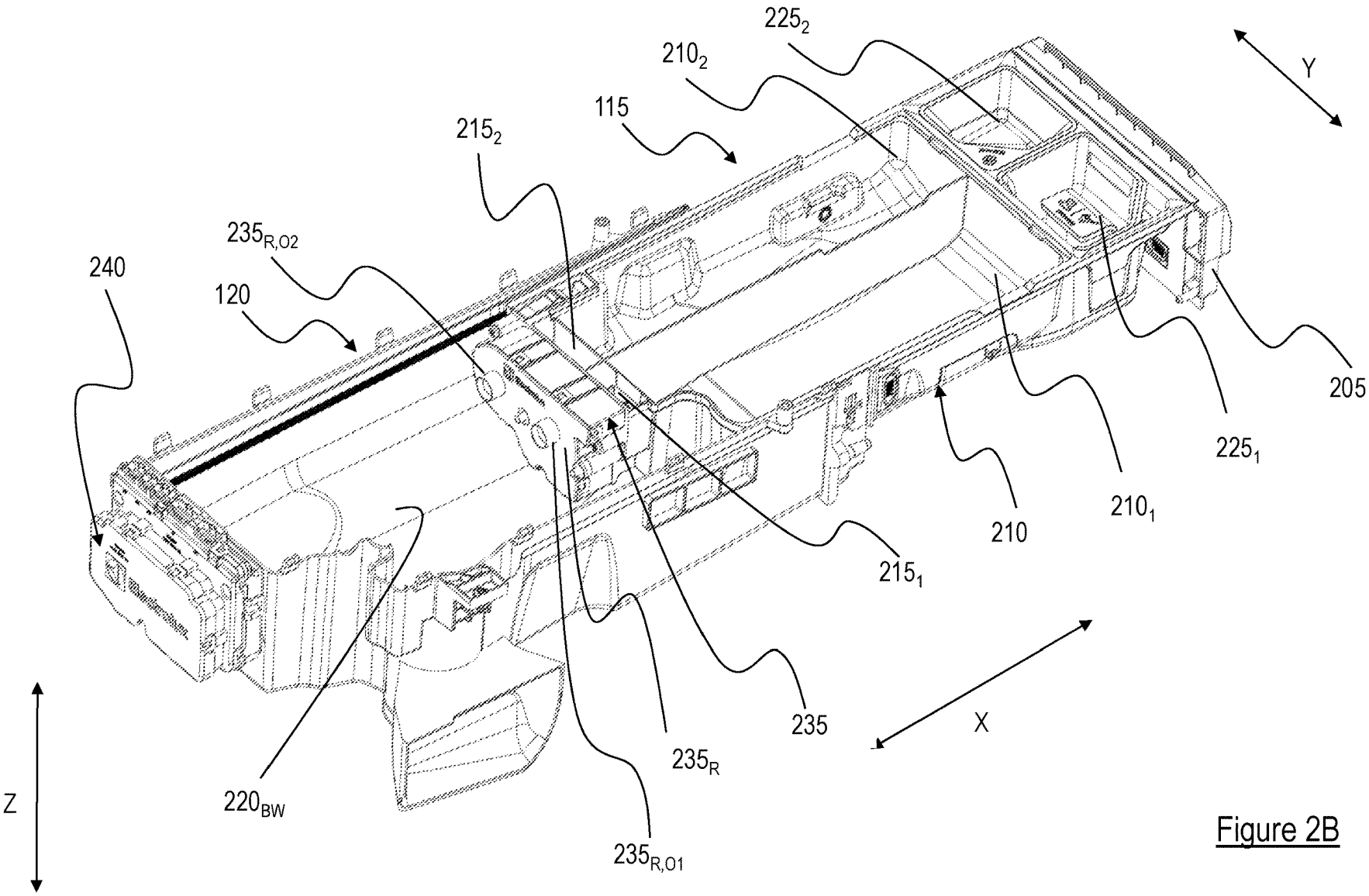
FIG. 2B shows a perspective view of the drawer of FIG. 2A in a partially extracted position within a drawer seat, according to an embodiment of the present invention.

The pumping members are advantageously enclosed, on a rear side of the drawer 115 (rear with respect to the drawer front along the sliding direction X), by a rotor shell 235 (visible in FIGS. 2A and 2B). More preferably, a rear wall $235_R$ of the rotor shell 235 comprises openings (two openings $235_{R,O1}$,$235_{R,O2}$ in the example at issue), through which the output shafts of the electric motors are able to pass for being coupled with the pumping members (particularly, with the seats thereof). Even more preferably, as illustrated, the openings $235_{R,O1}$,$235_{R,O2}$ are delimited by walls (e.g., tubular walls) projecting along the sliding direction X from the rear wall $235_R$ of the rotor shell 235; these projecting walls advantageously have centering, aligning and guiding functions for the output shafts to be passed into the openings $235_{R,O1}$,$235_{R,O2}$.

The electric motors are advantageously enclosed in a motor shell 240 (visible in FIG. 2B), preferably fixed on the drawer seat 120 (and, hence, separate from drawer body 210) and facing the rear wall $235_R$ of the rotor shell 235 along the sliding direction X. The motor shell 240 is preferably provided with openings, not shown, through which the output shafts of the electric motors project: in this way, when the drawer 115 is moved to the retracted position (i.e., towards the motor shell 240), the output shafts of the electric motors engage the pumping members, thus allowing mechanical and electrical connection therebetween.

Although not shown, the drawer 115 may comprise a drawer body cover for covering the drawer body 210. The drawer body cover may be configured to cover the drawer body 210 in correspondence of the multi-dose compartments $210_1$,$210_2$, thus leaving uncovered both the channels $215_1$, $215_2$, and particularly the top channel inputs thereof (which can therefore be accessed by water fed by a water distribution system, not shown, preferably provided at a top of the drawer seat 120). The drawer body cover may comprise one or more access openings, not shown, each one for accessing a respective multi-dose compartment $210_1$,$210_2$ for loading the treatment agent therein; one or more access components (such as one or more doors, for example one or more flap doors pivotally coupled to the drawer body cover) may advantageously be provided for selectively covering and uncovering the access openings thereby respectively preventing and allowing access to the respective multi-dose compartments $210_1$,$210_2$.

As mentioned above, the laundry appliance 100 may be operated (preferably upon configuring both the multi-dose compartments $210_1$,$210_2$ to contain multiple doses of the same type of treatment agent) in a coordinated operation mode in which, under the control of the control unit 130, a gradual concurrent emptying of the multi-dose compartments $210_1$,$210_2$ is exhibited by the laundry appliance 100 over one or more washing cycles. The coordinated operation mode is advantageously selected or enabled by the user, preferably by means of the user interface 125 (as better discussed in the following) and/or of the mobile application running on the user device UD. In alternative embodiments of the present invention, the coordinated operation mode is automatically set by the laundry appliance 100 (e.g., by the control unit 130), for example upon activation of the auto-dosing functionality.

Preferably, when the coordinated operation mode is enabled, the control unit 130 is configured to control the pump devices such as to cause them to coordinately draw up the treatment agent doses over one or more washing cycles by determining a gradual concurrent emptying of the multi-dose compartments $210_1$,$210_2$ over said one or more washing cycles.

According to a first implementation of the coordinated operation mode, the control unit 130 is configured to cause the pump devices to draw up the treatment agent doses coordinately during a single washing cycle.

In this implementation of the coordinated operation mode, the control unit 130 may be configured to cause the pump devices to draw up the treatment agent doses coordinately at a same phase of the single washing cycle (preferably, at same or substantially same time during the single washing cycle), e.g. in order to exploit same control signals from the control unit 130 (thus simplifying timing and processing operations to be executed by the control unit 130). Additionally or alternatively, the control unit 130 may be configured to cause the pump devices to draw up the treatment agent doses coordinately at different phases of (i.e., within) the single washing cycle, e.g. in order to implement specific features of the washing cycle (such as dispensing of the treatment agents in a distributed manner over two or more phases thereof). Just as an example, the control unit 130 may be configured to cause the pump devices to draw up the treatment agent doses coordinately at a same phase of the single washing cycle by default, or at different phases of the single washing cycle if the washing cycle so requires; additionally or alternatively, drawing up of the treatment agent doses at once (i.e., at the same phase of the single washing cycle, such as at the same time) or in a distributed manner (i.e., at different phases of the single washing cycle) may be an option selectable by the user through the user interface 125 and/or through the mobile application running on user device UD, with the selected option that can be advantageously stored by the laundry appliance 100 for following washing cycles (e.g., until this option is deselected) or be automatically deselected at the end of the washing cycle.

Therefore, when the coordinated operation mode is enabled, in the first implementation of the coordinated operation mode the control unit 130 is configured to control the pump devices such as to cause them to coordinately draw up the treatment agent doses over a single washing cycle by determining a gradual concurrent emptying of the multi-dose compartments $210_1$,$210_2$ over such washing cycle. Preferably, by gradual concurrent emptying it is meant, in the context of the first implementation of the coordinated operation mode, that the treatment agent doses drawn up from the multi-dose compartments $210_1$,$210_2$ determine substantially same level variations of the treatment agents contained in the multi-dose compartments $210_1$,$210_2$ over the single washing cycle; this means that the treatment agent doses drawn up from the multi-dose compartments $210_1$, $210_2$ comprise, during the single washing cycle, at least a first treatment agent dose drawn up from the multi-dose compartment $210_1$ and at least a second treatment agent dose drawn up from the multi-dose compartment $210_2$, wherein the first and second treatment agent doses are respective portions or apportioning of an overall amount of treatment agent to be used during the single washing cycle (the overall amount of treatment agent to be used during the single washing cycle for example depending on the selected washing cycle and/or on a level of dirt of the laundry load and/or on chemical properties of the treatment agents and/or on a weight of the laundry load and/or on a fine adjusting of the treatment agent doses performed by the user and discussed in the following).

The first and second treatment agent doses (or, equivalently, the first and second portions of the overall amount of treatment agent to be used during the single washing cycle) may be equal or different to each other. When, as herein exemplary assumed, the multi-dose compartments $210_1$, $210_2$ have different capacities, the first and second treatment agent doses are preferably different to each other, and are advantageously determined according to an overall capacity of the multi-dose compartments $210_1$,$210_2$ (e.g., the sum of the capacities of the multi-dose compartments $210_1$,$210_2$) and to the overall amount of treatment agent to be used during the single washing cycle. Preferably, the first and second treatment agent doses are proportional to the overall capacity and to the overall amount of treatment agent to be used during the single washing cycle. More preferably, the first treatment agent dose is proportional to a portion or percentage of the overall capacity that is associated with the multi-dose compartment 210$_1$, and the second treatment agent dose is proportional to a portion or percentage of the overall capacity portion that is associated with the multi-dose compartment 210$_2$. Denoting by $C_1$ and $C_2$ the capacities of the multi-dose compartments 210$_1$,210$_2$, and by A the overall amount of treatment agent to be used during the single washing cycle, the first $D_1$ and second $D_2$ treatment agent doses (preferably drawn up from the multi-dose compartment 210$_1$ and from the multi-dose compartment 210$_2$, respectively) may for example be determined as:

$$D_1 = A\frac{C_1}{C_1 + C_2}$$

$$D_2 = A\left(1 - \frac{C_1}{C_1 + C_2}\right) \rightarrow D_2 = A\frac{C_2}{C_1 + C_2}$$

wherein the term ($C_1$+$C_2$) represents the overall capacity.

As visible from the above equations, when $C_1$=$C_2$ (i.e., same capacities of the multi-dose compartments 210$_1$,210$_2$), $D_1$=$D_2$=A/2 (i.e., the first $D_1$ and second $D_2$ treatment agent doses are equal to each other and correspond each one to half of the overall amount A of treatment agent to be used during the single washing cycle); when instead $C_1 \neq C_2$ (i.e., different capacities of the multi-dose compartments 210$_1$,210$_2$), $D_1 \neq D_2$ (i.e., the first $D_1$ and second $D_2$ treatment agent doses differ from each other and correspond each one to a respective portion of the overall amount A of treatment agent to be used during the single washing cycle).

As mentioned above, when the pump devices are variable-flow peristaltic pump devices, the first $D_1$ and second $D_2$ treatment agent doses may be drawn up from the multi-dose compartments 210$_1$,210$_2$ based on equal (when $D_1$=$D_2$) or different (when $D_1$ $D_2$) rotor speeds of the pump devices; when instead the pump devices are fixed-flow peristaltic pump devices, the first $D_1$ and second $D_2$ treatment agent doses may be drawn up from the multi-dose compartments 210$_1$,210$_2$ based on equal (when $D_1$=$D_2$) or different (when $D_1 \neq D_2$) activation times of the pump devices (e.g., equal or different duty cycles of the corresponding control signals from the control unit 130).

According to a second implementation of the coordinated operation mode, the control unit 130 is configured to cause the pump devices to draw up the treatment agent doses coordinately during different (e.g., two or more) washing cycles, for example by properly alternating the drawing up of the treatment agent doses from the multi-dose compartment 210$_1$ and from the multi-dose compartment 210$_2$ over the washing cycles.

Therefore, when the coordinated operation mode is enabled, in the second implementation of the coordinated operation mode the control unit 130 is advantageously configured to control the pump devices such as to cause them to coordinately draw up the treatment agent doses over two or more washing cycles by determining a gradual concurrent emptying of the multi-dose compartments 210$_1$, 210$_2$ over such washing cycles. Preferably, by gradual concurrent emptying it is meant, in the context of the second implementation of the coordinated operation mode, that the treatment agent doses drawn up from the multi-dose compartments 210$_1$,210$_2$ determine substantially same level variations of the treatment agents contained in the multi-dose compartments 210$_1$,210$_2$ over the two or more washing cycles.

According to an embodiment, same level variations in the multi-dose compartments 210$_1$,210$_2$ over the two or more washing cycles may be obtained according to historical amounts of treatment agents drawn up in previous washing cycles in the multi-dose compartments 210$_1$,210$_2$. Preferably, during a current washing cycle, the control unit 130 may be configured to draw up the necessary treatment agent dose from the multi-dose compartment 210$_1$ if, during a number of previous washing cycles before the current washing cycle, the total amount of treatment agent drawn up from the multi-dose compartment 210$_1$ is lower than the total amount of treatment agent drawn up from the multi-dose compartment 210$_2$, or to draw up the necessary treatment agent dose from the multi-dose compartment 210$_2$ otherwise.

The number of previous washing cycles may for example be a predefined number of previous washing cycles before the current washing cycle. Additionally or alternatively, the number of previous washing cycles may comprise the previous washing cycles from an initial washing cycle, the initial washing cycle being for example the first washing cycle after both multi-dose compartments 210$_1$,210$_2$ have emptied and subsequently refilled by the user, and/or an arbitrary washing cycle selectable by the user (e.g., through the user interface 125 and/or through the mobile application running on the user device UD).

Considering for example seven treatment agent doses $D_A$-$D_G$ to be drawn up during respective seven washing cycles $WC_A$-$WC_G$ (with each treatment agent dose $D_A$, $D_B$, $D_C$, $D_D$, $D_E$, $D_F$, $D_G$ that thus represent the overall amount of treatment agent to be used during the single washing cycle $WC_A$, $WC_B$, $WC_C$, $WC_D$, $WC_E$, $WC_F$, $WC_G$, respectively), considering, just as an example, that the washing cycles $WC_A$, $WC_B$, $WC_C$, $WC_D$, $WC_E$, $WC_F$, $WC_G$ are consecutive washing cycles (i.e., with the washing cycle $WC_B$ that follows the washing cycle $WC_A$, with the washing cycle $WC_C$ that follows the washing cycle $WC_B$, with the washing cycle $WC_D$ that follows the washing cycle $WC_C$, with the washing cycle $WC_E$ that follows the washing cycle $WD_D$, with the washing cycle $WC_F$ that follows the washing cycle $WD_E$, and with the washing cycle $WC_G$ that follows the washing cycle $WD_E$), assuming that the washing cycle $WC_A$ is the initial washing cycle, and assuming $D_A$=60 ml, $D_B$=20 ml, $D_C$=30 ml, $D_D$=40 ml, $D_E$=40 ml, $D_F$=50 ml and $D_G$=70 ml (the different treatment agent doses depending, for example, on the selected washing cycle and/or on a level of dirt of the laundry load and/or on chemical properties of the treatment agents and/or on a weight of the laundry load and/or on a fine adjusting of the treatment agent doses performed by the user and discussed in the following), same level variations in the multi-dose compartments 210$_1$,210$_2$ over the seven washing cycles $WC_A$, $WC_B$, $WC_C$, $WC_D$, $WC_E$, $WC_F$, $WC_G$ may for example be obtained as follows:

- washing cycle $WC_A$: treatment agent dose $D_A$ drawn up from multi-dose compartment 210$_1$ (which is herein assumed to be set as default multi-dose compartment), the multi-dose compartment 210$_1$ thus experiencing a level variation of 60 ml;
- washing cycle $WC_B$: treatment agent dose $D_B$ drawn up from multi-dose compartment 210$_2$ (in that the level variation experienced so far by the multi-dose compartment 210$_2$, i.e. 0 ml, is lower than the level variation experienced so far by the multi-dose compartment 210$_1$, i.e. 60 ml), the multi-dose compartment 210$_2$ thus experiencing a level variation of 20 ml;
- washing cycle $WC_C$: treatment agent dose $D_C$ drawn up from multi-dose compartment 210$_2$ (in that the level variation experienced so far by the multi-dose compartment $\mathbf{210}_2$, i.e. 20 ml, is lower than the level variation experienced so far by the multi-dose compartment $\mathbf{210}_1$, i.e. 60 ml), the multi-dose compartment $\mathbf{210}_2$ thus experiencing an overall level variation of 50 ml (i.e., $D_B+D_C$) from the initial washing cycle $WC_A$;

washing cycle $WC_D$: treatment agent dose $D_D$ drawn up from multi-dose compartment $\mathbf{210}_2$ (in that the level variation experienced so far by the multi-dose compartment $\mathbf{210}_2$, i.e. 50 ml, is lower than the level variation experienced so far by the multi-dose compartment $\mathbf{210}_1$, i.e. 60 ml), the multi-dose compartment $\mathbf{210}_2$ thus experiencing an overall level variation of 90 ml (i.e., $D_B+D_C+D_D$) from the initial washing cycle $WC_A$;

washing cycle $WC_E$: treatment agent dose $D_E$ drawn up from multi-dose compartment $\mathbf{210}_1$ (in that the level variation experienced so far by the multi-dose compartment $\mathbf{210}_1$, i.e. 60 ml, is lower than the level variation experienced so far by the multi-dose compartment $\mathbf{210}_2$, i.e. 90 ml), the multi-dose compartment $\mathbf{210}_1$ thus experiencing an overall level variation of 100 ml (i.e., $D_A+D_E$) from the initial washing cycle $WC_A$;

washing cycle $WC_E$: treatment agent dose $D_E$ drawn from multi-dose compartment $\mathbf{210}_2$ (in that the level variation experienced so far by the multi-dose compartment $\mathbf{210}_2$, i.e. 90 ml, is lower than the level variation experienced so far by the multi-dose compartment $\mathbf{210}_1$, i.e. 100 ml), the multi-dose compartment $\mathbf{210}_2$ thus experiencing an overall level variation of 140 ml (i.e., $D_B+D_C+D_D+D_F$) from the initial washing cycle $WC_A$;

washing cycle $WC_G$: treatment agent dose $D_G$ drawn from multi-dose compartment $\mathbf{210}_1$ (in that the level variation experienced so far by the multi-dose compartment $\mathbf{210}_1$, i.e. 100 ml, is lower than the level variation experienced so far by the multi-dose compartment $\mathbf{210}_2$, i.e. 140 ml), the multi-dose compartment $\mathbf{210}_1$ thus experiencing an overall level variation of 170 ml (i.e., $D_A+D_E+D_G$) from the initial washing cycle $WC_A$.

Although not shown in the quantitative example of above, when the level variations experienced so far by the multi-dose compartments $\mathbf{210}_1$ and $\mathbf{210}_2$ are equal, the treatment agent dose may advantageously be drawn up from the default multi-dose compartment (i.e., the multi-dose compartment in the above example $\mathbf{210}_1$).

As mentioned above, each one of the treatment agent doses $D_A$-$D_G$ is drawn up from the multi-dose compartment $\mathbf{210}_1$ or from the multi-dose compartment $\mathbf{210}_2$ preferably based on respective rotor speeds of the pump devices when the pump devices are variable-flow peristaltic pump devices or based on respective activation times of the pump devices when instead the pump devices are fixed-flow peristaltic pump devices.

Thanks to the gradual concurrent emptying of the multi-dose compartments $\mathbf{210}_1$,$\mathbf{210}_2$ allowed by the coordinated operation mode (in both the first and second implementations thereof), the issues affecting the known laundry appliances are avoided, or at least drastically reduced. In fact, in the known laundry appliances featuring two multi-dose compartments containing the same type of treatment agent, the treatment agent doses are drawn up from a multi-dose compartment only when the other multi-dose compartment is empty. Therefore, one of the multi-dose compartments is emptied much before the other one, and hence it may be unused even for relatively long periods of time (i.e. until it is filled again, which typically takes place when also the other multi-dose compartment becomes empty). This involves that, in time, residues of treatment agent in the unused multi-dose compartment and/or in (unused) pipes of the associated unused pump device dry out and form encrustations or fouling that preclude the correct operation of the laundry appliance: in fact, in addition to promote accumulation of dirt (which contrasts with the purposes of sanitization of the laundry load), treatment agent incrustations in the unused multi-dose compartment may also detach from the compartment walls and be flushed undissolved through the pump devices (which could cause obstructions thereof) or through the treatment chamber (which could preclude a correct washing of the laundry load housed therein), whereas treatment agent incrustations in the unused pipes may prevent a correct flow of the treatment agent therethrough. On the contrary, thanks to the gradual concurrent emptying of the multi-dose compartments $\mathbf{210}_1$,$\mathbf{210}_2$ allowed by the present invention, no residues of treatment agent accumulates in the multi-dose compartments $\mathbf{210}_1$,$\mathbf{210}_2$ and/or in the suction $\mathbf{225}_1$,$\mathbf{225}_2$ and delivery $\mathbf{230}_1$,$\mathbf{230}_2$ pipes of the pump devices, and hence no encrustations or fouling are expected therein.

According to an embodiment of the present invention, which may be applied to the first and/or second implementation of the coordinated operation mode, when one of the multi-dose compartments $\mathbf{210}_1$,$\mathbf{210}_2$ contains an amount of treatment agent below a respective threshold amount, e.g. indicative of an alert (such as emptying or almost-emptying) level of the treatment agent or, equivalently, of an alert condition of that multi-dose compartment $\mathbf{210}_1$,$\mathbf{210}_2$, the laundry appliance 100 may output a corresponding error notification to the user (e.g. in the form of sound and/or light and/or text, preferably notified through the user interface 125 and/or the user device UD). If, in response to that, the user takes no action (i.e., no restoring of an amount of treatment agent above the respective threshold amount is performed by the user before the start of the washing cycle), the control unit 130 may be configured to automatically disable the coordinated operation mode (if previously enabled) and make it unavailable/non-selectable, and to cause (during execution of the selected washing cycle) activation of only the pump device associated with the other one of the multi-dose compartments $\mathbf{210}_1$,$\mathbf{210}_2$ (i.e. the multi-dose compartment that, still having an amount of treatment agent above the respective threshold amount, or safe level, is in a safe condition); in other words, when one of the multi-dose compartments $\mathbf{210}_1$,$\mathbf{210}_2$ contains an amount of treatment agent below the respective threshold amount, and no refilling (at least partial) is (purposely) performed by the user, all the treatment agent doses for the current washing cycle and for the following washing cycles are advantageously drawn up from the other one of the multi-dose compartments $\mathbf{210}_1$,$\mathbf{210}_2$ (when the auto-dosing functionality is activated). When instead, upon being notified from the laundry appliance 100 of the alert condition of one of the multi-dose compartments $\mathbf{210}_1$,$\mathbf{210}_2$, the user restores in it an amount of treatment agent above the respective threshold amount, the control unit 130 may be configured to automatically enable the coordinated operation mode or make it available/selectable for the user.

According to an alternative embodiment of the present invention, when one of the multi-dose compartments $\mathbf{210}_1$, $\mathbf{210}_2$ contains an amount of treatment agent below the respective threshold amount, no corresponding error notification may be output by the laundry appliance 100, e.g. to a design option of the laundry appliance 100 (however, same considerations may be applied if no error notification is output by the laundry appliance 100 due to a temporary malfunctioning thereof): therefore the user does not know about the alert condition of one of the multi-dose compartments $\mathbf{210}_1$,$\mathbf{210}_2$, unless he/she purposely opens the drawer 115 and inspects the multi-dose compartments $\mathbf{210}_1$,$\mathbf{210}_2$. In this case, the control unit 130 may be configured to automatically disable the coordinated operation mode, e.g. by causing, during execution of the selected washing cycle and of the following washing cycles, activation of only the pump device associated with the other one of the multi-dose compartments $\mathbf{210}_1$,$\mathbf{210}_2$ (i.e., the multi-dose compartment whose amount of treatment agent is still at a safe level): in other words, when one of the multi-dose compartments $\mathbf{210}_1$,$\mathbf{210}_2$ contains an amount of treatment agent below the respective threshold amount (alert condition), and no refilling (at least partial) is (unintentionally) performed by the user, all the treatment agent doses for the current washing cycle and for the following washing cycles are advantageously drawn up from the other one of the multi-dose compartments $\mathbf{210}_1$,$\mathbf{210}_2$ (when the auto-dosing functionality is activated).

In both the above embodiments, the drawing up of treatment agent doses exclusively from one of the multi-dose compartments $\mathbf{210}_1$,$\mathbf{210}_2$ may advantageously be continued (under the control of the control unit 130) until an amount of treatment agent below the respective threshold amount remains also in that multi-dose compartment $\mathbf{210}_1$,$\mathbf{210}_2$. When both multi-dose compartments $\mathbf{210}_1$,$\mathbf{210}_2$ contain amounts of treatment agent below the respective threshold amounts, the laundry appliance 100 may advantageously output a corresponding error notification to the user—e.g., in the form of sound and/or light and/or text—and the auto-dosing functionality may be deactivated and made unavailable/non-selectable, preferably until safe levels of treatment agents (i.e., amounts of treatment agent above the respective threshold amounts) are restored in both multi-dose compartments $\mathbf{210}_1$,$\mathbf{210}_2$.

In order to detect when the multi-dose compartments $\mathbf{210}_1$,$\mathbf{210}_2$ contain amounts of treatment agent below the respective threshold amounts, a detecting unit (not shown) may be provided in each multi-dose compartment $\mathbf{210}_1$, $\mathbf{210}_2$. The detecting unit may for example be an optical detecting unit. Although not shown, each optical detecting unit may advantageously comprise an optical guide preferably having a prismatic tip that, in use, protrudes into the respective multi-dose compartment $\mathbf{210}_1$,$\mathbf{210}_2$, a light emitter for emitting light into the optical guide, and an optical sensor for detecting different light refractions according to whether the treatment agent in the multi-dose compartment $\mathbf{210}_1$,$\mathbf{210}_2$ covers the prismatic tip or not. Therefore, when the treatment agent completely covers the prismatic tip, the light emitted by the light emitter is completely diffused into the respective multi-dose compartment $\mathbf{210}_1$,$\mathbf{210}_2$ and no, or substantially no, light is reflected back to the optical sensor (safe level); when instead no treatment agent covers the prismatic tip or when the treatment agent only partially covers the prismatic tip, the light emitted by the light emitter is completely or partially reflected back to the optical sensor by reflection taking place at the prismatic tip (alert level). The amount of reflected light detected by the optical sensor is converted into electric data by the optical sensor, which data are preferably fed to the control unit 130 for accordingly determining the safe condition or the alert condition of the respective multi-dose compartment $\mathbf{210}_1$,$\mathbf{210}_2$.

Preferably, the threshold amounts that allow discriminating between the alert and safe conditions of the respective multi-dose compartments $\mathbf{210}_1$,$\mathbf{210}_2$ depend on a distance of the optical guides from the bottoms of the respective multi-dose compartments $\mathbf{210}_1$,$\mathbf{210}_2$. More preferably, the distances of the optical guides from the bottoms of the respective multi-dose compartments $\mathbf{210}_1$,$\mathbf{210}_2$ may be different from each other, which could give rise to reciprocally different threshold amounts for the multi-dose compartments $\mathbf{210}_1$,$\mathbf{210}_2$ (the different threshold amounts for example taking into account the different capacities of the multi-dose compartments $\mathbf{210}_1$,$\mathbf{210}_2$).

Figure 3A:
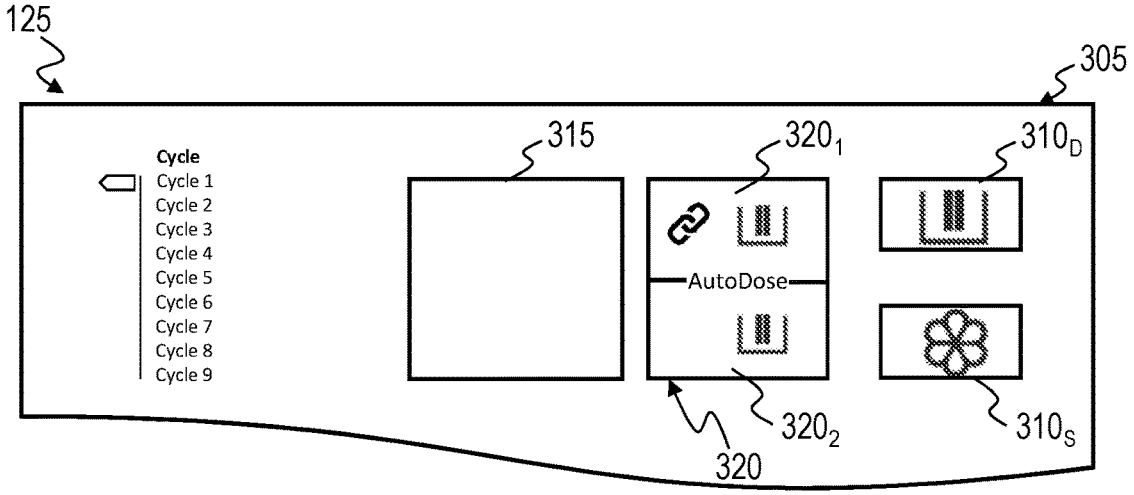
FIGS. 3A, 3B and 3C show portions of a user interface of the laundry appliance according to embodiments of the present invention.
Figure 3B:
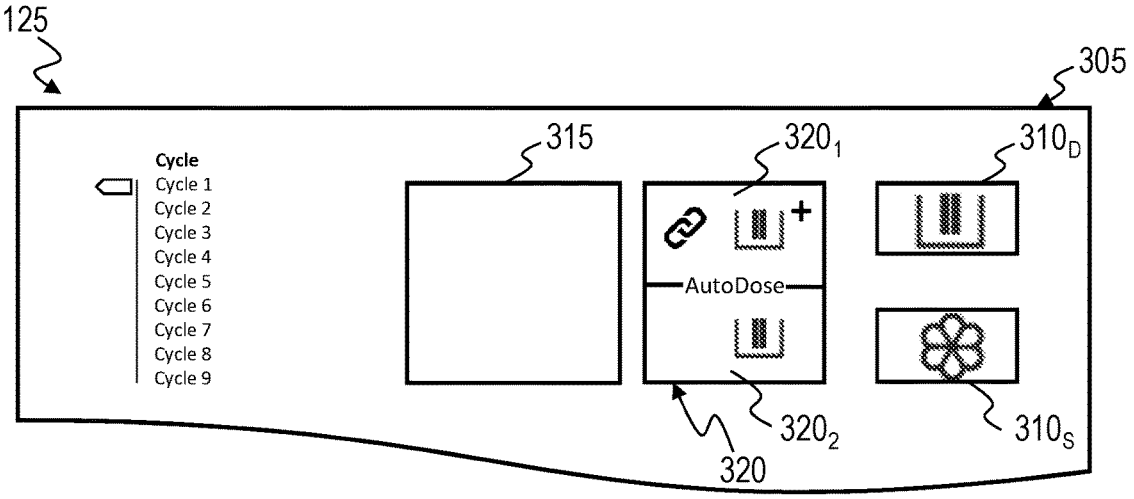
Figure 3C:
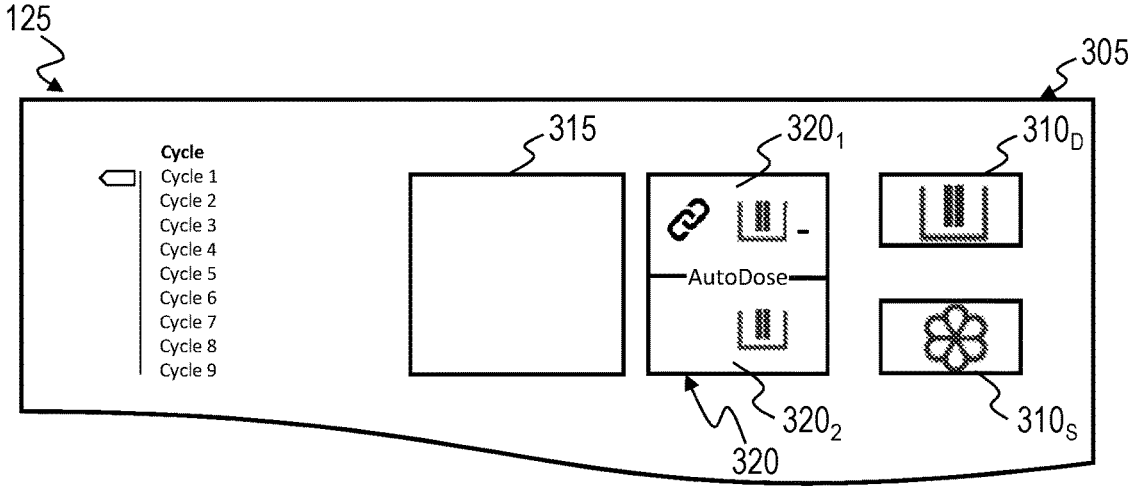

With reference now to FIGS. 3A-3C, they show portions of the user interface 125 according to embodiments of the present invention.

Preferably, although not necessarily, the user interface 125 comprises a display unit 305 for visually displaying one or more pieces of information; the display unit 305 may for example comprise a light emitting polymer display (LPD), a liquid crystal display, a thin film transistor-liquid crystal display, or an organic light-emitting diode display. In the preferred, not limiting, embodiment herein considered, the display unit 305 comprises a touch sensitive display unit to allow user selection of laundry appliance features by touching activated regions of the display unit 305.

The user interface 125 preferably comprises one or more control elements for allowing the user to select a washing cycle and to control one or more operating parameters of the selected washing cycle (including, but not limited to, temperature, laundry load dirt level, spin speed, start time delay, drawer compartment selection, selection of the type of treatment agent). The control elements may for example comprise physical control elements, i.e. control elements whose activation/deactivation is associated with displacements of mechanical components (such as the rotary knob visible in FIGS. 1A and 1B), and/or one or more virtual control elements, i.e. control elements whose activation/deactivation is associated with touch-sensitive electric components: for the purposes of the present disclosure, the virtual control elements comprise virtual input selectors or keys $\mathbf{310}_D$,$\mathbf{310}_S$, visible in FIGS. 3A-3C, each one preferably associated with a respective type of treatment agent (detergent or softener in the example at issue) that a selected multi-dose compartment $\mathbf{210}_1$,$\mathbf{210}_2$ may be configured to contain. However, the principles of the present invention equivalently apply when different combinations of physical and virtual control elements are provided (with the control elements that may for example be all physical control elements or all virtual control elements).

Although not shown, additional physical or virtual control elements may be provided (e.g., additional physical or virtual input keys for setting one or more parameters of the selected washing cycle, such as temperature, spin speed, amount of laundry load).

As exemplary illustrated, the display unit 305 comprises a cycle section, i.e. a section where a number of selectable washing cycles are listed. The washing cycles may be presented or listed with a graphic layout comprising textual indications (and/or symbols) associated with the selectable washing cycles. The textual indications (and/or associated symbols) are preferably vertically superimposed one to the other in order to form a column of textual indications (and/or associated symbols). In the example illustrated, the washing cycles are presented as a number of textual indications generically named "cycle 1", "cycle 2", "cycle 3", "cycle 4", "cycle 5", "cycle 6", "cycle 7", "cycle 8", "cycle 9", and may for example be conventional washing cycles including, but not limited to, "Cottons", "Cotton ECO" "Synthetics", "Delicates", "Wool/Handwash". The washing cycles may for example be selected through the above mentioned rotary knob, whose rotation advantageously causes a cursor or other pointer or slider to move vertically across the list of washing cycle to visually indicate to the user the currently selected washing cycle (however, embodiments of the present invention may be envisaged in which no rotary knob is provided and the cursor is a touch sensitive cursor moveable by user touch to select the washing cycle).

As exemplary illustrated, the display unit 305 advantageously comprises a display region 315 for displaying status information such as information about a status of one or more components of the laundry appliances 100 and/or information about a status of the washing cycle (including, but not limited to, information about a residual time to the end of the ongoing washing cycle, and/or information about a current phase of the ongoing washing cycle, and/or selected parameters for the ongoing washing cycle).

Preferably, as illustrated, the display unit 305 comprises a display region (or more thereof) 320 for displaying a graphical indication of a (e.g., activated or deactivated) status the auto-dosing functionality. More preferably, the display region (or more thereof) 320 is arranged for displaying a graphical indication of a (e.g., selected or deselected) status the coordinated operation mode. Even more preferably, the display region 320 comprises a (e.g., upper) display region $\mathbf{320}_1$ associated with the multi-dose compartment $\mathbf{210}_1$ and a (e.g., lower) display region $\mathbf{320}_2$ associated with the multi-dose compartment $\mathbf{210}_2$, the graphical indication of the coordinated operation mode for example comprising a symbol indicative of the type of treatment agent in both the upper $\mathbf{320}_1$ and lower $\mathbf{320}_2$ display regions, and preferably a (e.g., textual and/or graphical) symbol indicative of the coordinated operation mode (alternatively, the graphical indication of the coordinated operation mode may comprise only the symbol indicative of the coordinated operation mode).

In the illustrated example, the symbol indicative of the type of treatment agent in both the upper $\mathbf{320}_1$ and lower $\mathbf{320}_2$ display regions is the detergent symbol (which is advantageously the same symbol on the virtual input key $\mathbf{310}_D$), it meaning that in the example at issue both multi-dose compartments $\mathbf{210}_1$,$\mathbf{210}_2$ are configured to contain detergent. However, similar considerations apply if the both multi-dose compartments $\mathbf{210}_1$,$\mathbf{210}_2$ are configured to contain softener, in which case the type of treatment agent in both the upper $\mathbf{320}_1$ and lower $\mathbf{320}_2$ display regions would be the softener symbol (which is advantageously the same symbol on the virtual input key $\mathbf{310}_S$).

In the illustrated example, the symbol indicative of the coordinated operation mode is the "chain link" symbol, although this should not be construed limitatively. When the coordinated operation mode is selected, the "chain link" symbol may be displayed in the upper display region $\mathbf{320}_1$ (as exemplary illustrated), in the lower display region $\mathbf{320}_2$, or in both upper $\mathbf{320}_1$ and $\mathbf{320}_2$ lower display regions, the "chain link" symbol being preferably located close or in proximity of the symbol indicative of the type of treatment agent.

The coordinated operation mode may be selected by means of one or more input keys. These input key(s) may be provided on the user interface 125 and/or on the mobile application running on the user device UD. In the following, input key(s) provided on the user interface 125 will be discussed by way of example only, it being understood that analogous considerations apply, mutatis mutandis, to the mobile application running on the user device UD.

The input key(s) for selecting the coordinated operation mode may for example be dedicated input keys (not shown).

Alternatively, as in the preferred embodiment herein considered, the input key(s) for selecting the coordinated operation mode may comprise input keys already provided for other purposes (i.e., having default functions/options associated therewith). Preferably, the input key(s) comprise (s) one or more among the virtual input keys $\mathbf{310}_D$,$\mathbf{310}_S$, in which case the coordinated operation mode may for example be selectable by the user by means of a predefined touch or actuation sequence of the virtual input keys $\mathbf{310}_D$,$\mathbf{310}_D$. Just as an example, a first touch of the virtual input key 310 may configure the multi-dose compartment $\mathbf{210}_1$ to contain detergent (with the corresponding detergent symbol displayed in the upper display region $\mathbf{320}_1$), a second touch (following the first touch) of the virtual input key 310 may configure the multi-dose compartment $\mathbf{210}_2$ to contain detergent (with the corresponding detergent symbol displayed in the lower display region $\mathbf{320}_2$), a third touch (following the second touch) of the virtual input key 310 may enable selection of the coordinated operation mode (with the corresponding "chain link" symbol displayed in the upper $\mathbf{320}_1$ and/or lower $\mathbf{320}_2$ display regions), and a fourth touch (following the third touch) of the virtual input key $\mathbf{310}_D$ may determine both a reset of the configuration of the type of treatment agent (in this case, detergent) contained in the multi-dose compartments $\mathbf{210}_1$,$\mathbf{210}_2$ and the deselection of the coordinated operation mode (with the corresponding detergent and "chain link" symbols that are no longer displayed). Just as an another example, a first touch of the virtual input key $\mathbf{310}_S$ may configure the multi-dose compartment $\mathbf{210}_1$ to contain softener (with the corresponding softener symbol displayed in the upper display region $\mathbf{320}_1$), a second touch (following the first touch) of the virtual input key $\mathbf{310}_S$ may configure the multi-dose compartment $\mathbf{210}_2$ to contain softener (with the corresponding softener symbol displayed in the lower display region $\mathbf{320}_2$), a third touch (following the second touch) of the virtual input key $\mathbf{310}_S$ may enable selection of the coordinated operation mode (with the corresponding "chain link" symbol displayed in the upper $\mathbf{320}_1$ and/or lower $\mathbf{320}_2$ display regions), and a fourth touch (following the third touch) of the virtual input key $\mathbf{310}_S$ may determine both a reset of the configuration of the type of treatment agent (in this case, softener) contained in the multi-dose compartments $\mathbf{210}_1$,$\mathbf{210}_2$ and the deselection of the coordinated operation mode (with the corresponding softener and "chain link" symbols that are no longer displayed).

Preferably, the first touch of the virtual input key $\mathbf{310}_D$ or of the virtual input key $\mathbf{310}_S$ also allows contextual activation of the auto-dosing functionality. However, nothing prevents from allowing the activation of the auto-dosing functionality by means of one or more other physical and/or virtual input selectors, including for example dedicated physical and/or virtual input selectors, or physical and/or virtual input selectors already provided for other purposes (i.e., having default functions/options associated therewith), such as the physical and/or virtual input keys for setting one or more parameters of the selected washing cycle).

As mentioned above, the multi-dose compartments $\mathbf{210}_1$, $\mathbf{210}_2$ may be configured to contain multiple doses of reciprocally different types of treatment agent, i.e. with the multi-dose compartment $\mathbf{210}_1$ that may be configured to contain multiple doses of a type of treatment agent (e.g., the liquid washing detergent or the liquid softener) and with the multi-dose compartment $\mathbf{210}_2$ that may be configured to contain multiple doses of another type of treatment agent (e.g., the liquid softener or the liquid washing detergent, respectively). According to an embodiment of the present invention, the multi-dose compartments $210_1$,$210_2$ may be configured to contain multiple doses of reciprocally different types of treatment agent according to an order of touch of the virtual input keys $310_D$,$310_S$ (with a first touch of one of the virtual input keys $310_D$,$310_S$ that may for example be associated with the multi-dose compartment $210_1$, and with a second touch of the other virtual input key $310_S$, $310_D$ that may for example be associated with the multi-dose compartment $210_2$): just as an example, the first touch of the virtual input key $310_D$ or of the virtual input key $310_S$ may configure the multi-dose compartment $210_1$ to contain, respectively, detergent or softener (with the corresponding detergent symbol or softener symbol displayed in the upper display region $320_1$), and the second touch (following the first touch) respectively of the virtual input key $310_S$ or of the virtual input key $310_D$ may configure the multi-dose compartment $210_2$ to contain, respectively, softener or detergent (with the corresponding softener symbol or detergent symbol displayed in the lower display region $320_2$); in this configuration the coordinated operation mode is advantageously not selectable, and a subsequent touch of the virtual input key $310_D$ or of the virtual input key $310_D$ may instead determine a reset of the configuration of the type of treatment agent contained in the multi-dose compartments $210_1$, $210_2$.

As discussed above, in the preferred embodiment herein considered, the configurations of the types of treatment agent contained in the multi-dose compartments $210_1$,$210_2$, as well as the coordinated operation mode, are selectable by the user by means of respective predefined actuation sequences of the virtual input keys $310_D$,$310_S$; additionally or alternatively to that, they (or at least a subset thereof) could be selectable by the user by means of respective touch times of the virtual input keys $310_D$,$310_S$ (or of respective pressure times of corresponding physical input keys, when provided).

The user interface 125 advantageously comprises one or more control elements for adjusting the treatment agent doses with respect to reference or default treatment agent doses (hereinafter referred to as fine adjusting option).

The fine adjusting option may be accessed by means of one or more physical and/or virtual input keys, including for example one or more dedicated physical and/or virtual input keys (not shown), or one or more physical and/or virtual input keys already provided for other purposes (i.e., having default functions/options associated therewith). In the example at issue, the fine adjusting option is advantageously accessed by means of one or both of the virtual input keys $310_D$,$310_S$.

According to a preferred embodiment of the present invention, the physical and/or virtual input key(s) already provided for other purposes, such as one or both of the virtual input keys $310_D$,$310_S$ are configurable for accessing also the fine adjusting option through the user device UD.

Just as an example, upon configuration (by means of the virtual input keys $310_D$, $310_S$, as discussed above) of the multi-dose compartments $210_1$,$210_2$ with the respective types of treatment agent, and possibly upon enabling the coordinated operation mode, the enabling of the virtual input keys $310_D$,$310_S$ may for example allow the virtual input key $310_D$ to adjust the treatment agent dose to be drawn up from the multi-dose compartment $210_1$, and the virtual input key $310_S$ to adjust the treatment agent dose to be drawn up from the multi-dose compartment $210_2$.

Just as an example, a first touch of the virtual input key $310_D$ or of the virtual input keys $310_S$ may set an increase, e.g. by a first predefined amount, of the treatment agent dose to be drawn up from, respectively, the multi-dose compartment $210_1$ or from the multi-dose compartment $210_2$ (e.g., irrespective of the type of treatment agent with which the multi-dose compartments $210_1$,$210_2$ have been configured), a second touch (following the first touch) of the virtual input key $310_D$ or of the virtual input keys $310_S$ may set a decrease, e.g. by a second predefined amount (e.g., equal to or different from the first predefined amount), of the treatment agent dose to be drawn up from, respectively, the multi-dose compartment $210_1$ or from the multi-dose compartment $210_2$, whereas a third touch (following the second touch) of the virtual input key $310_D$ or of the virtual input keys $310_S$ may set, respectively, the multi-dose compartment $210_1$ or the multi-dose compartment $210_2$ back to the reference treatment agent doses.

In the illustrated example, when an increase or a decrease of the treatment agent dose is set for the multi-dose compartment $210_1$ or for the multi-dose compartment $210_2$, a corresponding symbol is displayed in the display region associated with that multi-dose compartment (in the example at issue, the upper display region $320_1$ or the lower display region $320_2$, respectively).

As visible in FIG. 3B, the symbol indicative of the increase of the treatment agent dose with respect to the reference treatment agent dose is advantageously the "+" symbol; the "+" symbol is preferably located close to the symbol of the type of treatment agent (the detergent symbol in the example at issue).

As visible in FIG. 3C, the symbol indicative of the decrease of the treatment agent dose with respect to the reference treatment agent dose is advantageously the "−" symbol; the "−" symbol is preferably located close to the symbol of the type of treatment agent (the detergent symbol in the example at issue). As visible in FIGS. 3B and 3C, the "+" and "−" symbols are preferably located alongside the symbol of the treatment agent type, more preferably at reciprocally different heights (with the "+" symbol that may for example be arranged as a "superscript", and with the "−" symbol that may for example be arranged as a "subscript"). The use of the "+" and "−" symbols, as well as their positions in the upper $320_1$ and lower $320_2$ display regions, are particularly easy to understand for the user.

Naturally, in order to satisfy local and specific requirements, a person skilled in the art may apply to the invention described above many logical and/or physical modifications and alterations. More specifically, although the invention has been described with a certain degree of particularity with reference to preferred embodiments thereof, it should be understood that various omissions, substitutions and changes in the form and details as well as other embodiments are possible. In particular, different embodiments of the invention may even be practiced without the specific details (such as the numeric examples) set forth in the preceding description for providing a more thorough understanding thereof, on the contrary, well known features may have been omitted or simplified in order not to obscure the description with unnecessary particulars.

The invention claimed is:

1. A laundry treatment appliance comprising:

a drawer comprising a first compartment and a second compartment, each of the first compartment and the second compartment being configured to contain multiple respective doses of a respective treatment agent for laundry treatment, wherein the first compartment and the second compartment comprise the same type of treatment agent, a first pump and a second pump configured to draw up respective treatment agent doses from the first compartment and the second compartment, respectively, and a control unit configured to control the first pump and the second pump, wherein the control unit is configured to cause the first pump and the second pump to coordinately draw up the treatment agent doses over at least one washing cycle by determining a gradual concurrent emptying of the first compartment and the second compartment over said at least one washing cycle.

2. The laundry treatment appliance according to claim 1, wherein the at least one washing cycle comprises a single washing cycle, and the control unit is configured to cause the first pump and second pump to draw up the treatment agent doses during said single washing cycle.

3. The laundry treatment appliance according to claim 2, wherein the control unit is configured to cause the first pump and the second pump to draw up the treatment agent doses at a same phase of said single washing cycle.

4. The laundry treatment appliance according to claim 2, wherein the control unit is configured to cause the first pump and the second pump to draw up the treatment agent doses at the same time during said single washing cycle.

5. The laundry treatment appliance according to claim 1, wherein the at least one washing cycle comprises a first washing cycle and a second washing cycle, and wherein the treatment agent doses comprise first and second treatment agent doses, and the control unit is configured to cause the first pump and second pump to draw up the first and second treatment agent doses during said first and second washing cycles, respectively.

6. The laundry treatment appliance according to claim 1, wherein the control unit is configured to cause the first pump and second pump to draw up the treatment agent doses by controlling rotor speeds of the first pump and the second pump, and/or by controlling activation times of the first pump and the second pump.

7. The laundry treatment appliance according claim 1, wherein the control unit is configured to detect when the first compartment or the second compartment contains an amount of treatment agent below respective first and second threshold amounts, respectively, and the control unit is further configured to cause only the second pump or the first pump, respectively, to draw up the treatment agent doses from the second compartment or the first compartment, respectively.

8. The laundry treatment appliance according to claim 1, further comprising at least one input selector configured to receive a user selection of an operation mode in which the control unit is configured to cause the first pump and second pump to draw up the treatment agent doses coordinately over the at least one washing cycle.

9. The laundry treatment appliance according to claim 8, wherein at least one of the at least one input selector is configurable to provide, in addition to one or more default functions thereof, an adjusting function configured to receive a user adjustment of the treatment agent doses with respect to reference treatment agent doses.

10. The laundry treatment appliance according to claim 9, wherein said at least one of the at least one input selector is configurable through an external device being external to the laundry treatment appliance.

11. A method for operating a laundry treatment appliance comprising a drawer comprising a first compartment and a second compartment, each of the first compartment and the second compartment being adapted to contain respective multiple doses of a respective treatment agent for laundry treatment, wherein the first compartment and the second compartment comprise the same type of treatment agent, and a first pump and a second pump configured to draw up treatment agent doses from the first compartment and the second compartment, respectively, wherein the method comprises operating the first pump and the second pump to coordinately draw up respective treatment agent doses over at least one washing cycle by determining a gradual concurrent emptying of the first compartment and the second compartment over said at least one washing cycle.

12. The method according to claim 11, wherein said operating the first pump and second pump to coordinately draw up respective treatment agent doses over at least one washing cycle comprises operating the first pump and the second pump to provide substantially same level variations of the treatment agents contained in the first compartment and the second compartment over said at least one washing cycle.

13. The method according to claim 11, wherein the at least one washing cycle comprises a single washing cycle, and wherein the respective treatment agent doses drawn up from the first compartment and the second compartment are respective first and second portions of an overall amount of treatment agent to be used during the single washing cycle, and the method further comprises determining said first and second portions according to respective capacities of the first compartment and the second compartment and to said overall amount of treatment agent to be used during the single washing cycle.

14. A laundry treatment appliance comprising:

a drawer comprising a first compartment and a second compartment, each of the first compartment and the second compartment being configured to contain multiple respective doses of a respective treatment agent for laundry treatment, a first pump and a second pump configured to draw up respective treatment agent doses from the first compartment and the second compartment, respectively, a control unit configured to control the first pump and the second pump, wherein the control unit is configured to cause the first pump and the second pump to coordinately draw up the treatment agent doses over at least one washing cycle by determining a gradual concurrent emptying of the first compartment and the second compartment over said at least one washing cycle, and an input selector operatively connected to the control unit, the input selector comprising an adjusting function configured to receive a user adjustment of the treatment agent doses with respect to reference treatment agent doses.

15. The laundry treatment appliance of claim 14, wherein the first compartment and the second compartment are each configurable to contain multiple doses of a first type of treatment agent or of a second type of treatment agent, and the control unit is configured to cause the first pump and second pump to coordinately draw up the treatment agent doses over at least one washing cycle when the first compartment and the second compartment are configured to contain the same type of treatment agent.

16. The laundry treatment appliance of claim 14, wherein the input selector is configurable through an external device being external to the laundry treatment appliance.

17. The laundry treatment appliance of claim 14, wherein the at least one washing cycle comprises a single washing cycle, and the control unit is configured to cause the first pump and second pump to draw up the treatment agent doses during said single washing cycle.

18. The laundry treatment appliance of claim 17, wherein the control unit is configured to cause the first pump and the second pump to draw up the treatment agent doses at a same phase of said single washing cycle.

19. The laundry treatment appliance of claim 17, wherein the control unit is configured to cause the first pump and the second pump to draw up the treatment agent doses at the same time during said single washing cycle.

20. The laundry treatment appliance of claim 14, wherein the at least one washing cycle comprises a first washing cycle and a second washing cycle, and wherein the treatment agent doses comprise first and second treatment agent doses, and the control unit is configured to cause the first pump and second pump to draw up the first and second treatment agent doses during said first and second washing cycles, respectively.

* * * * *